US009086029B2

(12) United States Patent
Riepl et al.

(10) Patent No.: US 9,086,029 B2
(45) Date of Patent: Jul. 21, 2015

(54) METHOD FOR OPERATING AN INJECTION SYSTEM

(71) Applicants: Hans Riepl, Hemau (DE); Tobias Ritsch, Dieterskirchen (DE)

(72) Inventors: Hans Riepl, Hemau (DE); Tobias Ritsch, Dieterskirchen (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/360,037

(22) PCT Filed: Nov. 20, 2012

(86) PCT No.: PCT/EP2012/073132

§ 371 (c)(1),
(2) Date: May 22, 2014

(87) PCT Pub. No.: WO2013/076095

PCT Pub. Date: May 30, 2013

(65) Prior Publication Data

US 2014/0379238 A1 Dec. 25, 2014

(30) Foreign Application Priority Data

Nov. 24, 2011 (DE) ..... 10 2011 087 055

(51) Int. Cl.

| | |
|---|---|
| ***F02D 41/38*** | (2006.01) |
| ***F02M 63/02*** | (2006.01) |
| ***F02D 41/22*** | (2006.01) |
| ***F02M 59/36*** | (2006.01) |
| *F02M 37/04* | (2006.01) |

(52) U.S. Cl.

CPC ..... *F02D 41/3845* (2013.01); *F02D 41/221* (2013.01); *F02M 59/368* (2013.01); *F02M 63/028* (2013.01); *F02D 2041/224* (2013.01); *F02D 2200/0602* (2013.01)

(58) Field of Classification Search

CPC ..... F02D 14/38; F02D 41/18; F02D 41/3845; F02D 2200/0402; F02D 41/22; F02M 37/04

See application file for complete search history.

(56) References Cited

U.S. PATENT DOCUMENTS

| | | | | |
|---|---|---|---|---|
| 6,230,688 | B1 * | 5/2001 | Faix et al. | 123/495 |
| 7,325,537 | B2 | 2/2008 | Mueller et al. | 123/506 |
| 8,528,522 | B2 * | 9/2013 | Li | 701/102 |

FOREIGN PATENT DOCUMENTS

| | | | | |
|---|---|---|---|---|
| DE | 19913477 | A1 | 10/2000 | F02D 41/02 |
| DE | 102004056665 | A1 | 6/2006 | F02D 1/02 |

(Continued)

OTHER PUBLICATIONS

International Search Report and Written Opinion, Application No. PCT/EP2012/073132, 10 pages, Jan. 25, 2013.

*Primary Examiner* — Hieu T Vo

(74) *Attorney, Agent, or Firm* — Slayden Grubert Beard PLLC

(57) ABSTRACT

A method is provided for operating an injection system of a motor vehicle, which injection system is designed as an adjusting system having volumetric flow rate control via a normally open inlet valve. If a fault of the inlet valve leading to undesired closing of the inlet valve is detected, the inlet valve is closed already during the suction phase of the high-pressure pump by applying current and is opened again during a part of the suction phase corresponding to a pumping demand in order to thereby control or at least reduce the flow rate of the high-pressure pump. Thus, corresponding safety measures, such as a pressure-limiting valve in the high-pressure region, can be omitted.

14 Claims, 2 Drawing Sheets

(56) References Cited

FOREIGN PATENT DOCUMENTS

| | | | | |
|---|---|---|---|---|
| DE | 102006000483 | A1 | 4/2007 | F02D 41/22 |
| EP | 0375944 | A2 | 7/1990 | F02D 41/38 |
| EP | 1296061 | A2 | 3/2003 | F02M 59/36 |
| EP | 2241744 | A1 | 10/2010 | F02M 59/02 |
| WO | 2008/001176 | A2 | 1/2008 | F02D 13/00 |
| WO | 2013/076095 | A1 | 5/2013 | F02D 41/22 |

* cited by examiner

METHOD FOR OPERATING AN INJECTION SYSTEM

CROSS-REFERENCE TO RELATED APPLICATIONS

This application is a U.S. National Stage Application of International Application No. PCT/EP2012/073132 filed Nov. 20, 2012, which designates the United States of America, and claims priority to DE Application No. 10 2011 087 055.5 filed Nov. 24, 2011, the contents of which are hereby incorporated by reference in their entirety.

TECHNICAL FIELD

The present invention relates to a method for operating an injection system of a motor vehicle, said injection system being in the form of a single-controller system with volume flow regulation by means of a normally-open inlet valve and having a high-pressure pump, a high-pressure accumulator, a high-pressure sensor, injectors and a control unit.

BACKGROUND

In injection systems, inadmissible pressure increases can occur in the system in the event of a fault. In particular in the case of modern injection systems which have high-pressure pumps controlled by means of a digital inlet valve, problems can arise in an inlet valve of said type. Specifically, in the case of a normally-open inlet valve which is held in the open state by a spring, in the event of a spring fracture, undesired or excessively early closure of the valve during the delivery phase of the high-pressure pump can result in an undesired pressure build-up in the high-pressure region, caused by an undesired delivery rate of or full delivery by the high-pressure pump up to a critical pressure level. Such a fault can lead to an undesired pressure build-up in the high-pressure volume, which can damage the system and possibly lead to external leakage.

To prevent such damage, it is known for a pressure limiting valve (PLV) to be provided in order to protect the system and the components in the high-pressure region, which pressure limiting valve prevents an excessive build-up of pressure. Said pressure limiting valve is generally a mechanical overpressure valve which is connected to the high-pressure-conducting components, for example to the high-pressure pump, to the high-pressure accumulator (rail) or to the injectors, and which discharges excess fuel quantities from the high-pressure system, for example into the pump return line or into a separate return line.

For rail pressure regulation (pressure regulation in the high-pressure accumulator), the single-controller system described above uses only volume flow regulation of the high-pressure pump by means of said inlet valve.

SUMMARY

One embodiment provides a method for operating an injection system of a motor vehicle, said injection system being in the form of a single-controller system with volume flow regulation by means of a normally-open inlet valve and having a high-pressure pump, a high-pressure accumulator, a high-pressure sensor, injectors and a control unit, wherein, if a fault of the inlet valve is detected which leads to undesired or excessively early closing thereof, said inlet valve is closed by energization already during the suction phase of the high-pressure pump and is reopened only during a part of the suction phase that corresponds to a delivery demand, in order thereby to regulate or at least reduce the delivery rate of the high-pressure pump.

In a further embodiment, the fault is detected by comparison of a system pressure value or system pressure increase gradient measured by the high-pressure sensor in the high-pressure region with a corresponding predefined threshold value.

In a further embodiment, the injection system is operated without a pressure-limiting valve in the high-pressure region.

In a further embodiment, the injection valve is energized beyond the suction phase or is permanently energized.

In a further embodiment, the inflow pressure (upstream of the inlet valve) of a predelivery pump is reduced.

BRIEF DESCRIPTION OF THE DRAWINGS

Aspects of the invention are explained in detail below with reference to the drawing, in which.

DETAILED DESCRIPTION

Figure 1:
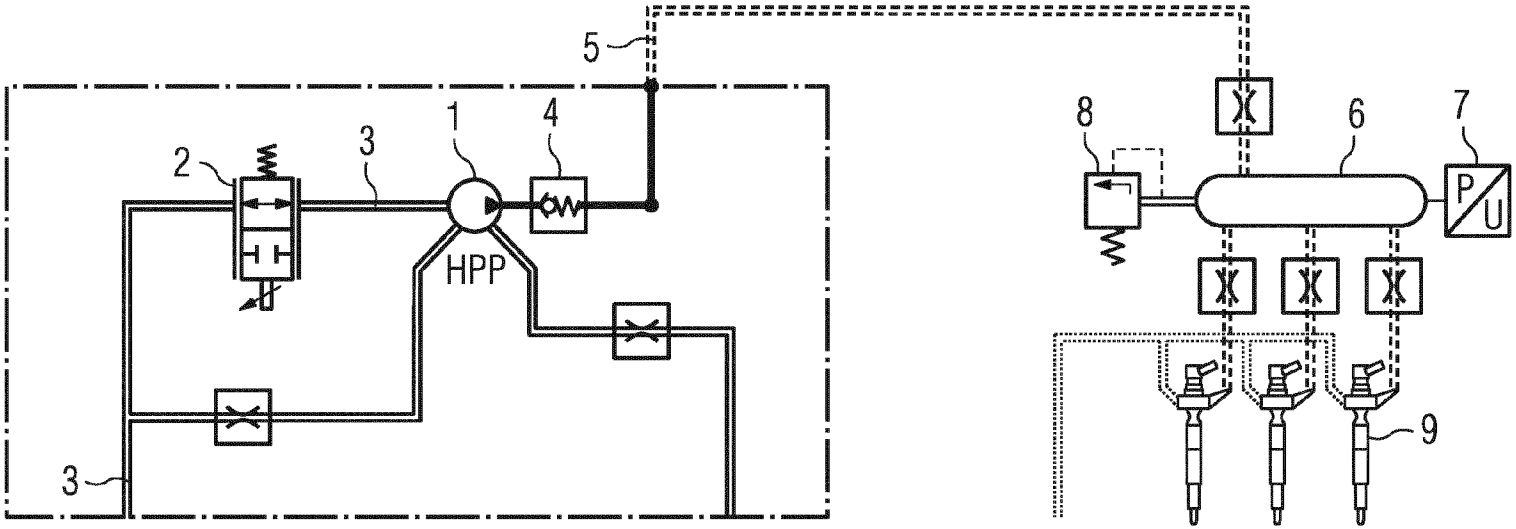
FIG. 1 shows a schematic hydraulic circuit diagram of an injection system (common rail system)

Some embodiments of the invention provide a method of the type described in the introduction, with which a critical pressure build-up in the high-pressure region in the event of a fault of an inlet valve can be prevented with particularly little outlay.

In some embodiments of the method, if a fault of the inlet valve is detected which leads to undesired or excessively early closing thereof, said inlet valve is closed by energization already during the suction phase of the high-pressure pump and is reopened only during a part of the suction phase that corresponds to a delivery demand, in order thereby to regulate or at least reduce the delivery rate of the high-pressure pump.

During the suction phase of a high-pressure pump implemented with a normally-open inlet valve, the valve is not energized during regular operation. The inlet valve is thus held open, for example by means of a spring and the prevailing inflow pressure, during the entire suction phase of the high-pressure pump. At a defined time during the delivery phase, the inlet valve is energized and thus closed. In this way, the amount of fuel situated in the displacement body chamber at said time is compressed and delivered into the high-pressure region. If a fault, for example a spring fracture, occurs in the case of a normally-open inlet valve of said type, then owing to the absence of spring force, the inlet valve closes already at an undesired time, even without energization, owing to the pressure in the displacement body chamber during the movement of the pump displacement body from bottom dead centre to top dead centre of the high-pressure pump (pressure in the displacement body chamber>inflow pressure). The high-pressure pump thus undesirably delivers more fuel into the high-pressure region than desired, which can lead to the problems mentioned in the introduction.

According to some embodiments, upon detection of said fault, the inlet valve is closed by energization already during the suction phase of the high-pressure pump and is reopened only during a part of the suction phase that corresponds to a delivery demand. This alone has the effect that the intake of the fuel is eliminated to a corresponding extent or minimized. In this fault situation, it is thus nevertheless possible for the delivery rate of the high-pressure pump to be regulated or reduced or minimized by means of the fuel flow rate flowing into the displacement body chamber during the suction phase of the high-pressure pump.

In other words, therefore, during a fault situation detected by means of the control unit of the injection system, the energization of a normally-open inlet valve is relocated from the delivery phase of the high-pressure pump to the suction phase of the high-pressure pump. By means of said modified actuation of the inlet valve for the fault situation, the fuel delivery rate and thus the pressure in the high-pressure region of the system can still be regulated to a restricted extent, or can at least be reduced, even in the fault situation, for example in the case of a broken spring.

The fault may be detected by comparison of a system pressure value or system pressure increase gradient measured by the high-pressure sensor in the high-pressure region with a corresponding threshold value. It is also possible for the exceedance of a differential margin with respect to a predefined setpoint pressure to be determined. If the fault is detected in this way by the control unit, the latter triggers an energization of the inlet valve, which leads, as a function of the demanded injection quantity, to an at least partial opening during the suction phase and thus to the desired pressure reduction in the high-pressure region, thus permitting regulation of the pump delivery rate.

The injection system may be operated without a pressure-limiting valve in the high-pressure region. Such a pressure-limiting valve in the high-pressure region of the injection valve can be dispensed with because the stated fault situation cannot result in a critical pressure build-up in the high-pressure region. The injection system can thus be realized at particularly low cost but nevertheless so as to be robust in the fault situation.

An advantage is also achieved in a usage situation in combination with a pressure-limiting valve (PLV), because in this case, by means of the suction phase of the high-pressure pump, a pressure range can be set in the operating range, and the vehicle can travel onward in the normal operating range. Without said function, the PLV limits the pressure, which in the fault situation can no longer be regulated.

In a further embodiment, the injection valve may be energized beyond the suction phase or may be permanently energized. It is also optionally possible for the inflow pressure (upstream of the inlet valve) of a predelivery pump to be reduced in order to further optimize the force equilibrium on the inlet valve in the closed state in order to assist in preventing charging of the cylinder of the high-pressure pump.

It is accordingly possible in the fault situation, for example in the event of fracture and/or jamming of a valve spring in the valve, for the delivery rate of the pump resulting from undesired or excessively early closure of the valve during the delivery phase of the high-pressure pump to be minimized by energization already during the suction phase and, if appropriate, by energization beyond the suction phase of the high-pressure pump or by permanent energization of the inlet valve.

The injection system of a motor vehicle which is schematically illustrated in FIG. 1 has a fuel line 3 originating from a fuel tank and leading to a high-pressure pump (HPP) 1. The high-pressure pump has a digital inlet valve 2 and an outlet valve 4. The low-pressure fuel that is supplied via the line 3 is supplied by means of the high-pressure pump 1 to a high-pressure accumulator (common rail) 6 via a high-pressure line 5, and is discharged from said accumulator 6 to individual injectors 9. The high-pressure accumulator 6 is assigned a high-pressure sensor 7 and a pressure limiting valve (PLV) 8.

Said injection system corresponds to the prior art. It is a so-called single-controller system which, for rail pressure regulation (pressure regulation in the high-pressure accumulator 6), uses only volume flow regulation of the high-pressure pump 1 by means of said digital inlet valve 2. Said inlet valve 2 is a normally-open inlet valve which is held in the open state by a spring. In the event of a spring fracture or in the event of jamming of the spring, an undesired or excessively early closure of the valve during the delivery phase of the high-pressure pump 1 may lead to an undesired pressure build-up in the high-pressure region. To prevent this, the pressure limiting valve (PLV) 8 is provided, which is a mechanical overpressure valve which discharges excess fuel quantities from the high-pressure system into the pump return line.

Figure 2:
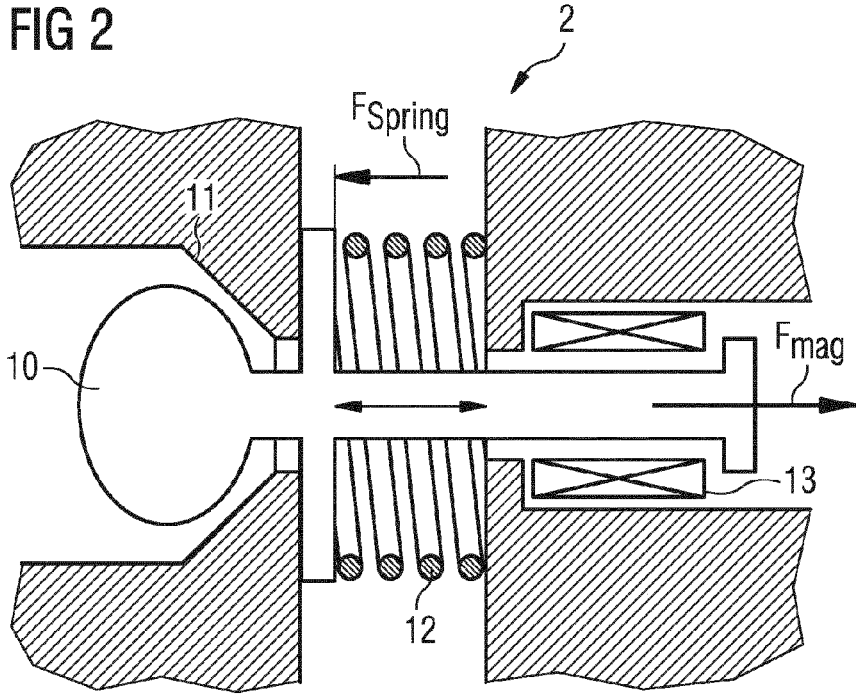
FIG. 2 is a schematic illustration of a normally-open digital inlet valve of the high-pressure pump of the injection system.
Figure 3:
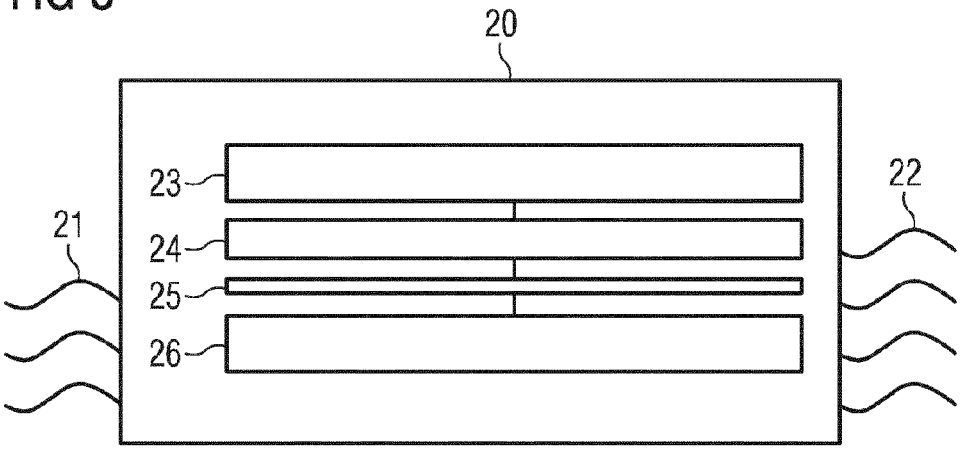
FIG. 3 is a schematic illustration of a control unit with corresponding inlets and outlets and a flow diagram of the method according to the invention.

FIG. 2 schematically shows the construction of a normally-open digital inlet valve 2 of said type. In this case, a valve element 10 interacts with a valve seat 11 and opens and closes a corresponding fuel throughflow opening in a controlled manner. FIG. 2 shows the valve in the open state. Said state is realized by a spring 12, wherein in this state, the valve is deenergized, that is to say the associated electromagnet 13 is not excited. A closure of the valve 2 is effected by the electromagnet 13 counter to the force of the spring 12. During the suction phase of the high-pressure pump 1, the digital inlet valve 2 in the prior art embodiment illustrated in FIG. 1 is in the normally-open state. The corresponding functions are controlled by the control unit 20 schematically illustrated in FIG. 3.

According to embodiments, it is now provided that, if a fault of the inlet valve is detected which leads to undesired closing thereof, said inlet valve is energized already during the suction phase of the high-pressure pump and is at least partially reopened when required, in order thereby to reduce the delivery rate of the high-pressure pump and prevent corresponding damage in the high-pressure region. Here, the disclosed process is as illustrated in the flow diagram of FIG. 3. In the event of a fault of the digital inlet valve 2 of the high-pressure pump 1, said fault is detected by means of the provided high-pressure sensor 7 and the electrical control unit (ECU) 20. Here, for example, an excessively steep pressure increase gradient or an excessively high pressure level in the high-pressure accumulator is detected. This takes place in step 23 in FIG. 3. If the control unit 20 detects a corresponding fault, it switches to fault operation in step 24. The switch from regular control operation of the digital inlet valve 2 to fault control operation is depicted in step 25. In step 26, the control unit 20 controls the inlet valve 2 in the fault control operating mode such that the inlet valve 2 is energized already during the suction phase and is reopened, by restoring the energization, only during a part of the suction phase that corresponds to a delivery demand, in order thereby to regulate or at least reduce the delivery rate of the high-pressure pump. In this way, the intake of fuel is at least partially prevented or minimized and thus the delivery rate of the high-pressure pump is reduced or minimized by means of the fuel quantity flowing into the displacement body chamber during the suction phase of the high-pressure pump, and thus an excessively high pressure build-up in the high-pressure accumulator is prevented. The pressure limiting valve 8 shown in FIG. 1 in the prior art embodiment can thus be dispensed with by implementing the method according to the invention.

The reference numeral 21 schematically indicates the inputs of the control unit (ECU) 20 from temperature sensor, high-pressure sensor 7 etc., and the reference numeral 22 schematically indicates the corresponding outputs to the digital inlet valve 2, to the predelivery pump etc.

What is claimed is:

1. A method for operating an injection system of a motor vehicle, said injection system comprising a single-controller system with volume flow regulation via a normally-open inlet valve and having a high-pressure pump, a high-pressure accumulator, a high-pressure sensor, injectors and a control unit, the method comprising:

operating the inlet valve according to a repeated process of a suction phase followed by a delivery phase, detecting a fault of the inlet valve that leads to an undesired closing of the inlet valve, in response to detecting the fault of the inlet valve:

closing said inlet valve during the suction phase of the high-pressure pump by energizing the inlet valve, and reopening the inlet valve only during a part of the suction phase that corresponds to a delivery demand, thereby regulating an intake of fuel into the inlet valve to control a delivery rate of the high-pressure pump.

2. The method of claim 1, comprising detecting the fault by comparing a system pressure value or system pressure increase gradient measured by the high-pressure sensor with a corresponding predefined threshold value.

3. The method of claim 1, comprising operating the injection system without a pressure-limiting valve associated with the high-pressure pump.

4. The method of claim 1, comprising, in response to detecting the fault of the inlet valve, energizing the injection valve beyond the suction phase.

5. The method of claim 1, comprising reducing an inflow pressure of a predelivery pump upstream of the inlet valve.

6. The method of claim 1, comprising, in response to detecting the fault of the inlet valve, permanently energizing the injection valve.

7. The method of claim 1, wherein detecting a fault of the inlet valve that leads to an undesired closing of the inlet valve comprises detecting a fault of the inlet valve that leads to an excessively early closing of the inlet valve.

8. A control system for operating an injection system of a motor vehicle, said control system providing volume flow regulation via a normally-open inlet valve and comprising:

a high-pressure pump, a high-pressure accumulator, a high-pressure sensor, injectors, and a control unit programmed to:

operate the inlet valve according to a repeated process of a suction phase followed by a delivery phase, detect a fault of the inlet valve that leads to an undesired closing of the inlet valve, in response to detecting the fault of the inlet valve:

close said inlet valve during the suction phase of the high-pressure pump by energizing the inlet valve, and reopen the inlet valve only during a part of the suction phase that corresponds to a delivery demand, thereby regulating an intake of fuel into the inlet valve to control a delivery rate of the high-pressure pump.

9. The control system of claim 8, wherein the control unit is programmed to detect the fault by comparing a system pressure value or a system pressure increase gradient measured by the high-pressure sensor with a corresponding predefined threshold value.

10. The control system of claim 8, wherein the control system operates the injection system without a pressure-limiting valve associated with the high-pressure pump.

11. The control system of claim 8, wherein the control unit is programmed to, in response to detecting the fault of the inlet valve, energize the injection valve beyond the suction phase.

12. The control system of claim 8, wherein the control unit is programmed to, in response to detecting the fault of the inlet valve, permanently energize the injection valve.

13. The control system of claim 8, wherein the control unit is programmed to reduce an inflow pressure of a predelivery pump upstream of the inlet valve.

14. The control system of claim 8, wherein detecting a fault of the inlet valve that leads to an undesired closing of the inlet valve comprises detecting a fault of the inlet valve that leads to an excessively early closing of the inlet valve.

* * * * *